US006175309B1

(12) United States Patent
Drake et al.

(10) Patent No.: US 6,175,309 B1
(45) Date of Patent: Jan. 16, 2001

(54) 270 DEGREE MOTION SENSOR

(75) Inventors: Michael Drake, Stoney Creek; Raymond J. Hiller, Chapel Hill, both of NC (US)

(73) Assignee: Regent Lighting Corporation, Burlington, NC (US)

( * ) Notice: Under 35 U.S.C. 154(b), the term of this patent shall be extended for 0 days.

(21) Appl. No.: 09/479,738

(22) Filed: Jan. 7, 2000

Related U.S. Application Data

(60) Provisional application No. 60/145,771, filed on Jul. 27, 1999.

(51) Int. Cl.[7] ..... G08B 13/08

(52) U.S. Cl. ..... 340/545.3; 340/541; 340/565; 340/693.5; 340/693.6; 340/693.9; 340/693.11; 250/353; 250/342; 250/DIG. 1

(58) Field of Search ..... 340/545.3, 541, 340/551, 552, 553, 555, 556, 565, 693.5, 693.6, 693.9, 693.11, 693.12; 250/338.1, 339.02, 353, 342, DIG. 1

(56) References Cited

U.S. PATENT DOCUMENTS

| | | | | |
|---|---|---|---|---|
| 4,757,204 | * | 7/1988 | Baldwin et al. | 250/342 |
| 5,015,994 | * | 5/1991 | Hoberman et al. | 340/567 |
| 5,103,346 | * | 4/1992 | Chang | 359/855 |
| 5,308,985 | * | 5/1994 | Lee | 250/353 |
| 5,386,210 | * | 1/1995 | Lee | 340/567 |
| 5,393,978 | * | 2/1995 | Schwarz | 250/353 |
| 5,418,368 | * | 5/1995 | Sandell et al. | 250/353 |
| 5,442,532 | * | 8/1995 | Boulos et al. | 362/276 |
| 5,641,964 | * | 6/1997 | Taniguchi | 250/353 |
| 5,662,411 | * | 9/1997 | Haslam et al. | 362/276 |
| 5,677,529 | * | 10/1997 | Hofmann et al. | 250/221 |
| 5,717,203 | * | 2/1998 | Yung | 250/221 |
| 5,763,842 | * | 6/1998 | Ness | 250/214 AL |
| 5,867,099 | * | 2/1999 | Keeter | 340/567 |
| 5,946,209 | * | 8/1999 | Eckel et al. | 364/143 |
| 5,973,594 | * | 10/1999 | Baldwin et al. | 340/506 |
| 6,100,803 | * | 8/2000 | Chang | 340/567 |

* cited by examiner

*Primary Examiner*—Jeffery A. Hofsass
*Assistant Examiner*—Toan Pham
(74) *Attorney, Agent, or Firm*—Niro, Scavone, Haller & Niro

(57) ABSTRACT

The present invention concerns a motion sensor for use with a light. The device includes a housing having an outer edge and an interior space in which a plurality of sensors are located. The sensors convert infrared into an electronic signal that is processed to detect motion. A lens located is also used which is located on an outer edge of the housing for directing infrared to the sensors which may be generally arranged in a U-shaped pattern to promote a 270 degree motion detection zone. The ends of the lens are recessed into and held in the interior of the housing a spaced distance from the outer edge of said housing so as to detect motion occurring rearward of the sensors.

5 Claims, 3 Drawing Sheets

10
56
54
58
60
52
50
62
3
3
40

270 DEGREE MOTION SENSOR

This Application claims priority to U.S. provisional patent application Ser. No. 60/145,771, filed Jul. 27, 1999.

BACKGROUND OF THE INVENTION

The invention relates to an outdoor light fixture which has a motion sensing function. More particularly, the device relates to a motion sensor which has a detection range of 270 degrees.

SUMMARY OF THE INVENTION

In one embodiment of the present invention, the outdoor light fixture is adapted to sense motion in a 270 degree motion detection zone. To accomplish this, three sensors are arranged behind a Fresnel lens. Two of the three sensors are placed a spaced distance apart and parallel to each other and the third sensor is perpendicular to the other sensors. This forms a U-shaped configuration which permits a 270 degree detection pattern.

In another embodiment, the housing of the motion sensor is configured in a compact design. Rather than having a lens which contains a bulbous 270 degree or greater lens on the end, which extends beyond the outer periphery of the housing, recesses are used to inset the lens while still maintaining a 270 degree configuration.

DESCRIPTION OF THE DRAWINGS

These and other features, objects and advantages of the present invention will become apparent from the following description and drawings wherein like reference numerals represent like elements in several views, and in which.

DESCRIPTION OF THE PREFERRED EMBODIMENTS

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

Figure 1:
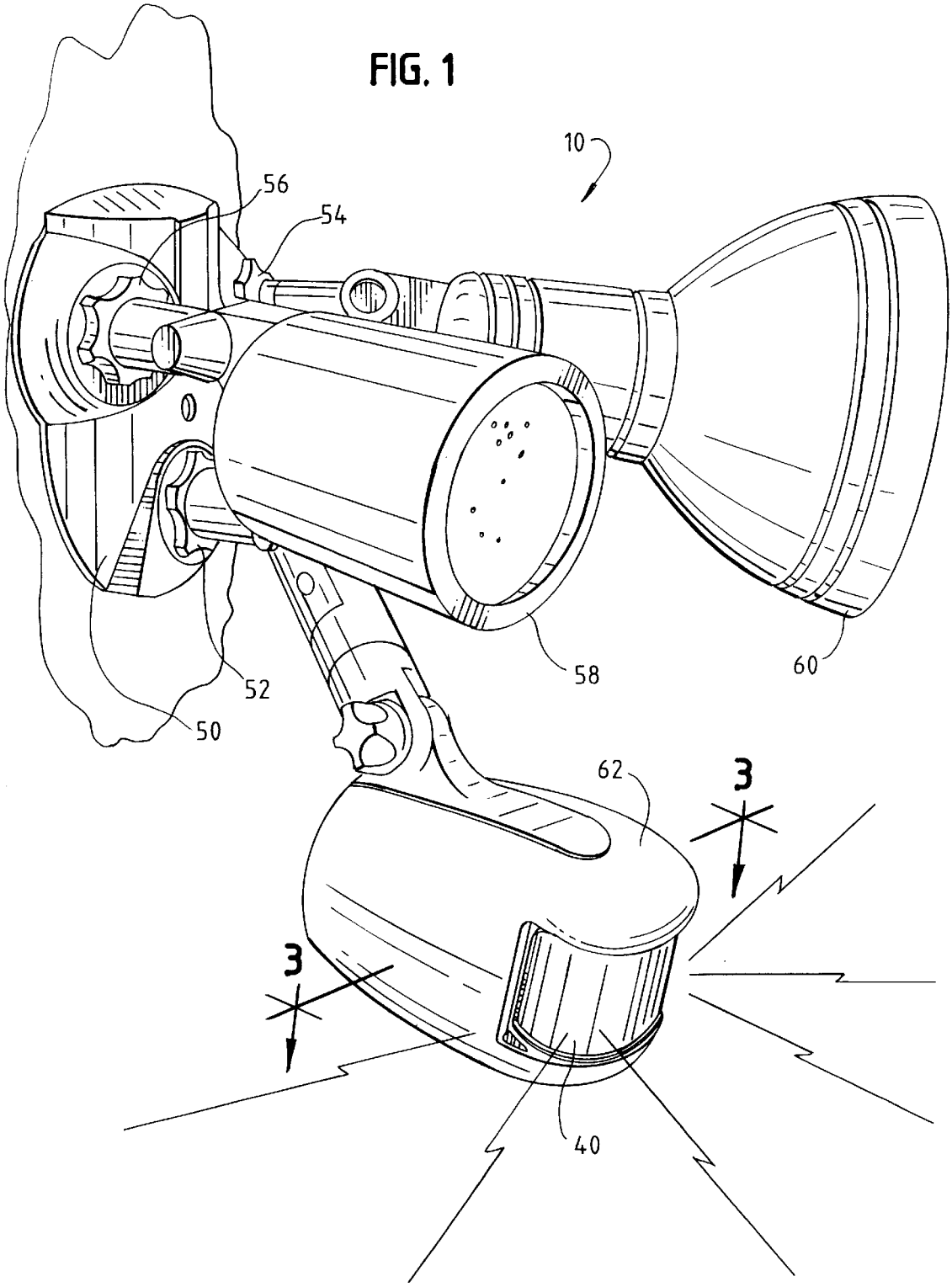
FIG. 1 shows a perspective view of an embodiment of the invention having a 270 degree detection pattern.

As shown in FIG. 1, outdoor light fixture 10 includes a cover plate 50, fasteners 52, 54 and 56 as well as light housings 58 and 60. Also included is a motion sensor 62 which detects motion as a change in infrared. The design of the components described above are well known to those of skill in the art.

Motion sensor 62 includes a housing 12 which securely retains Fresnel lens 40. As known to those of skilled in the art, lens 40 directs infrared to sensors 11 which in turn produce an electronic signal which corresponds to the amount of infrared detected. The signal in turn is processed by electronic circuitry to determine if motion has occurred. There is a number of ways in which the circuitry used to detect motion maybe designed which is well known to those of skill in the art.

To achieve a 270 degree motion detection zone or pattern, lens 40 is formed into at least a 270 degree arc. Lens 40 surrounds a plurality of sensors 11A, 11B and 11C. The sensors are arranged to receive infrared from the Fresnel lens and convert the infrared into an electronic signal. The design and construction of sensors 11A–C are well known to those of skill in the art. It has been found that by arranging the lens in a U-shaped pattern, 270 degrees of detection may be obtained. However, by placing the lens on the end of the housing in the required arc, without modifying the housing, a bulbous looking device with a fully exposed lens results. This not only presents an aesthetic displeasing appearance, it is also not a very structurally sound design.

Figure 3:
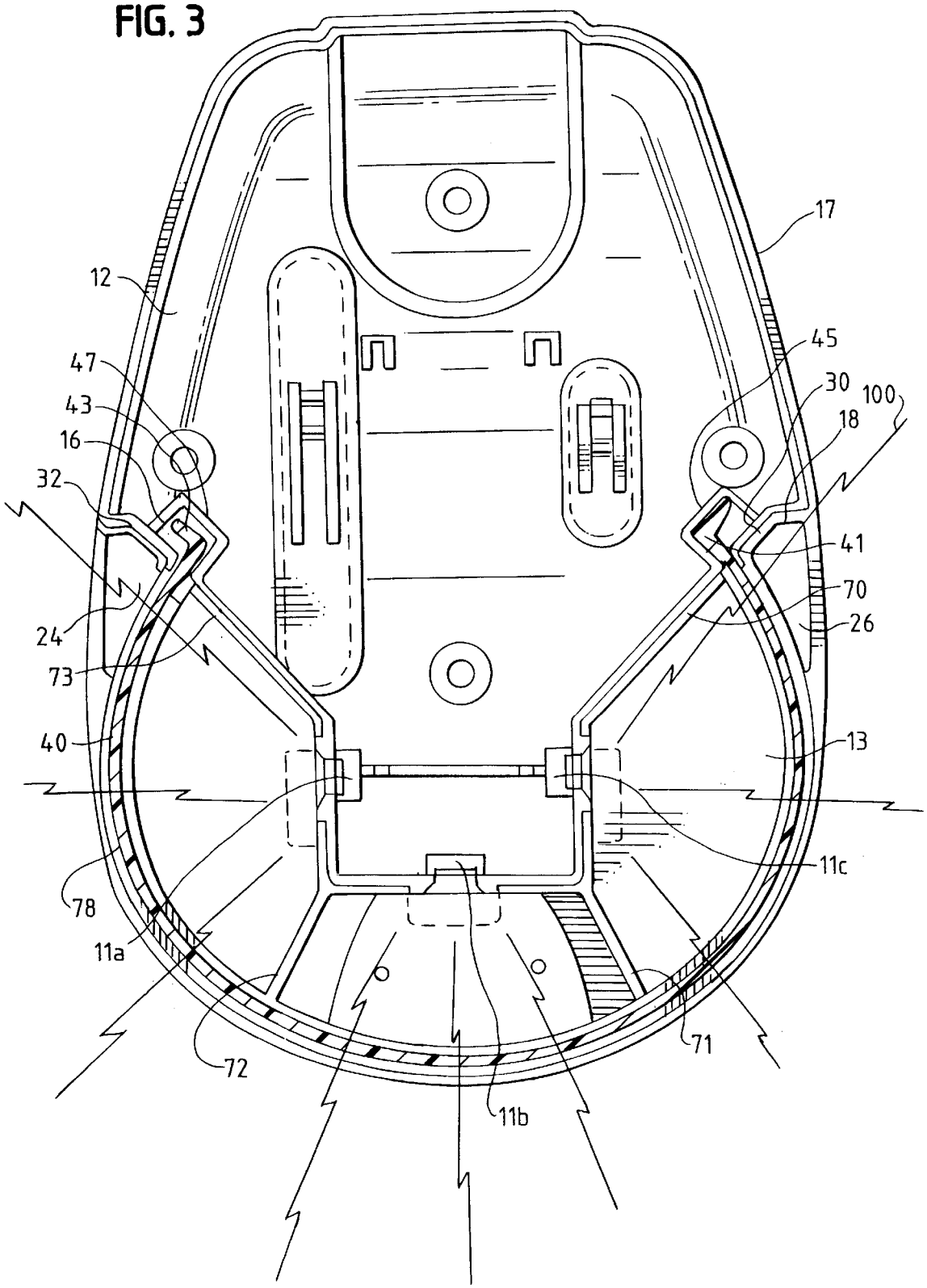
FIG. 3 is a cross-sectional view taken along line 3—3 of the lower housing shown in FIG. 2.

To overcome these design drawbacks, it has been found that lens 40 may be fully enclosed by housing 12 through the use of recesses or detents 24 and 26 located on the housing near ends 16 and 18 of lens 40. This allows lens 40 to be located in the interior 13 of housing 12 rather than at the outer periphery 17. To further facilitate a full range of detection, interior walls 30 and 32 of housing 12 may be angled inwardly as shown in FIG. 3. This configuration creates a compact design which is structurally sounder and more aesthetically pleasing by eliminating the bulbous look and containing lens 40 withing the outer edge or periphery of the housing.

Figure 2:
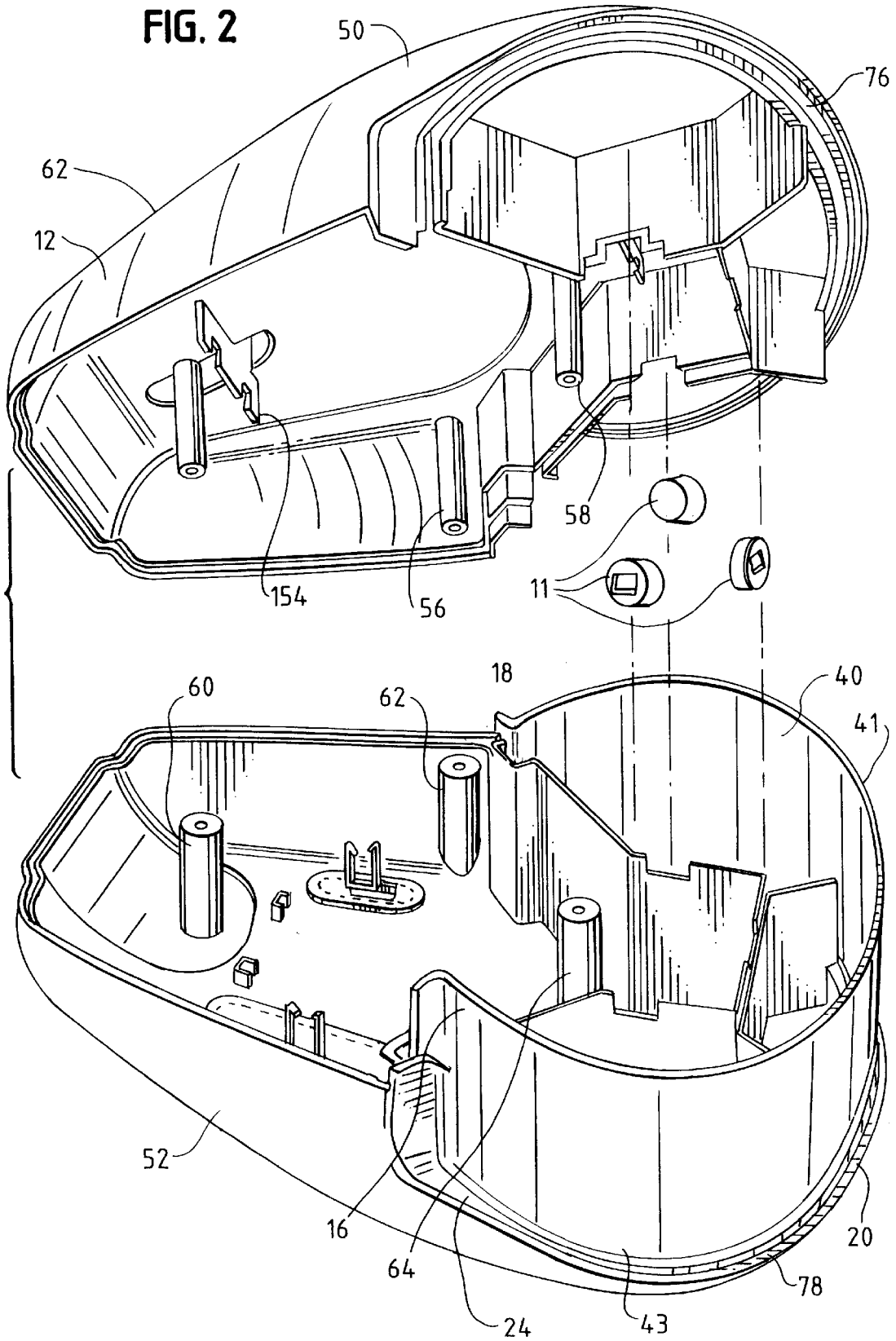
FIG. 2 shows an exploded perspective view of the housing shown in FIG. 1.

As shown in FIG. 2, housing 12 may be made of molded plastic and formed into two halves 50 and 52 that fit together. Collinerally aligned posts 54, 56, 58, 60 and 64 may be used to secure the halves together and for internal support. Other internal supports for securing the other components may be molded into the housing as well. To maintain the 270 degree arc of lens 40, internal supports 70–73 may also be used to maintain and support the necessary curvature. In addition, hooked ends 41 and 43 of lens 40 which are held in place by catches 45 and 47 assist in maintaining the position of the lens by preventing forward movement of the lens during assembly and the like. Moreover, housing 12 may include opposingly located channels 76 and 78 which are sized to receive edges 41 and 43 of lens 40 to secure the lens within the housing.

In use, the recesses or detents 24 and 26 cooperate with angled walls 30 and 32 to achieve a 270 degree arc of detectable motion. As shown in FIG. 3, an infrared signal 100 that is generated from a location generally rearward of the device may still be sensed by one of the sensors since the housing has been adapted to no longer obstruct the infrared from reaching the lens and receptor.

While the invention has been described with reference to the preferred embodiments thereof, it will be appreciated that numerous variations, modifications, and alternate embodiments are possible, and accordingly, all such variations, modifications, and alternate embodiments are to be regarded as being within the spirit and scope of the invention.

What is claimed is:

1. A motion sensor for use with a light comprising:

a housing having an outer edge and an interior space;

a plurality of sensors located within said interior space of the housing for converting infrared into an electronic signal;

a lens located on said outer edge of the housing for directing infrared to said sensors;

said lens forming at least a 270 degree arc about said sensors to create at least a 270 degree motion detection zone; and said lens having two opposing ends which are recessed into and held in the interior of said housing a spaced distance from the outer edge of said housing to permit detection of rearwardly generated infrared.

2. The device of claim 1 wherein said housing further includes angled interior walls located at the opposing ends of said lens.

3. The device of claim 1 further including catches in said housing to securely hold said ends of said lens.

4. The device of claim 1 further including sensors arranged in a U-shaped pattern.

5. The device of claim 1 further including opposing channels which are sized to receive the lens.

* * * * *